United States Patent [19]

Hungerford

[11] Patent Number: 5,001,967

[45] Date of Patent: Mar. 26, 1991

[54] MODULAR AIR BAR

[76] Inventor: John W. Hungerford, 7217 San Lucas, Carlsbad, Calif. 92009

[21] Appl. No.: 367,131

[22] Filed: Jun. 16, 1989

Related U.S. Application Data

[63] Continuation-in-part of Ser. No. 258,708, Oct. 17, 1988, Pat. No. 4,869,157.

[51] Int. Cl.[5] ..... F24F 13/072

[52] U.S. Cl. ..... 98/40.17; 98/40.16

[58] Field of Search ..... 98/40.05, 40.14, 40.16, 98/40.17

[56] References Cited

U.S. PATENT DOCUMENTS

| | | | |
|---|---|---|---|
| 3,276,348 | 10/1966 | Kennedy | 98/40.16 |
| 3,302,550 | 2/1967 | Thomson | 98/40.16 |
| 3,308,744 | 3/1967 | Schach | 98/40.17 |
| 3,411,425 | 11/1968 | Lambert | 98/40.16 |
| 3,444,801 | 5/1969 | Lambert | 98/40.16 |
| 3,601,033 | 8/1971 | Lambert | 98/40.16 |
| 3,760,709 | 9/1973 | Rachlin et al. | 98/40.16 |
| 3,919,928 | 11/1975 | Lambert | 98/40.16 |
| 4,316,407 | 2/1982 | Lambert | 98/40.16 |

FOREIGN PATENT DOCUMENTS

| | | | |
|---|---|---|---|
| 142834 | 5/1985 | European Pat. Off. | 98/40.17 |
| 2518609 | 11/1976 | Fed. Rep. of Germany | 98/40.17 |
| 2308873 | 11/1976 | France | 98/40.17 |
| 1361077 | 7/1974 | United Kingdom | 98/40.16 |
| 1470139 | 4/1977 | United Kingdom | 98/40.17 |
| 2195758 | 4/1988 | United Kingdom | 98/40.16 |

*Primary Examiner*—Harold Joyce
*Attorney, Agent, or Firm*—John M. Harrison

[57] ABSTRACT

A modular air bar for mounting in the ceiling system of a structure, which modular air bar is characterized by a pivoting air controlling section sandwiched between a pair of spaced sliding controller modules, each of the latter having a pair of spaced air deflectors provided with curved, facing interior air channels and fitted with horizontally-spaced top and bottom spacers at each end. A pair of sliding horizontal pattern controllers are laterally mounted between the spacers in each of the sliding controller modules and the pattern controllers extend substantially throughout the length of the deflectors in a middle segment thereof. A pair of pivoting pattern controllers are mounted in the pivoting air controlling section between the sliding controller modules in the modular air bar, in order to deflect air flowing through the modular air bag around the air channels and directionally distribute the air through an air slot between the deflectors, into the structure.

12 Claims, 2 Drawing Sheets

AIR FLOW

AIR FLOW

MODULAR AIR BAR

BACKGROUND OF THE INVENTION

Cross-Reference to Related Application

This application is a Continuation-In-Part of my copending U.S. Pat. application Ser. No. 07/258,708, Filed Oct. 17, 1988, 4,869,157.

FIELD OF THE INVENTION

This invention relates to linear air diffusers and more particularly, to a self-supporting linear and modular air bar which serves to diffuse air in selected patterns from the ceiling plenum of a structure. In a preferred embodiment of the invention the modular air bar is characterized by a pivoting air controlling section sandwiched between a pair of spaced sliding controller modules, each of the latter having a pair of spaced deflectors connected by horizontally-oriented spacers at each end, which spacers slidably contain a pair of horizontal pattern controllers that extend along the length of the deflectors. A pair of pivoting pattern controllers are installed in spaced relationship in the pivoting air controlling section between end segments of the deflectors. The deflectors are each fitted with at least one, and preferably two oppositely-disposed, curved air channels which terminate at a common bottom air slot. These air channels are designed to receive air from the plenum and direct the air through the modular air bar according to the position of the slidably mounted horizontal pattern controllers and the spaced pivoting pattern controllers, across the air channel or channels and through the air slot, for directional air diffusion into a room of the structure. In another preferred embodiment of the invention the spacers mounted in the ends of the deflectors are very narrow. This facilitates maximum air flow space along the length of the deflectors through the open passages created by laterally slidable manipulation of the respective horizontal pattern controllers and pivotal adjustment of the pivoting pattern controllers in the pivoting air controlling section, to directionally diffuse the air in selected patterns into a room of the structure.

The use of suspended ceilings which extend downwardly from the permanent ceiling or roof of a building or structure has become widespread and esthetic considerations require that lighting fixtures, air conditioning outlets and like equipment and accessories be flush-mounted with the suspended ceiling. The space between the suspended and permanent ceiling is known as a "plenum" and usually receives air conditioning ducts, cables, piping and similar equipment. This type of construction presents numerous air handling problems, particularly in large structures, since changes in the number and location of personnel occupying such structures often require frequent and extensive adjustment of the air distribution mechanism, in order to effectively provide suitable air handling and conditioning. The older diffusion outlets which extend below the plane of a suspended ceiling are not normally used in modern construction designs and these older fixtures usually require highly specialized and sometimes expensive extrusions which greatly increase the cost of the air conditioning installation.

Suspended ceiling-integrated air distribution systems require the following components: a plenum, an air chamber or chambers designed to collect air from a source of supply; an air diffuser assembly to distribute the air to a designated room or rooms in the structure; and a return air system for returning the air from the room or rooms to the source of supply. One technique for returning the air to the source of supply utilizes return air ducts located in the walls beneath the suspended ceiling and one or more air passages are normally provided to return the air to the supply source.

DESCRIPTION OF THE PRIOR ART

Many of the structures which have been proposed and used for air handling and distribution systems in connection with suspended ceilings suffer from a common disadvantage, in that they must be assembled at the suspended ceiling level. This method of assembly is difficult and usually results in a very high, and sometimes prohibitive, labor cost.

While the various air diffusing systems hereinafter disclosed in the prior art detail apparatus for creating a diffused air flow which operate successfully in many applications, there are some instances where a more focused air flow, as well as multiple streams of air from a single diffuser, are highly desirable. This is particularly true for air handling and conditioning systems that must operate in a structure characterized by a non-homogeneous temperature, such as a room that contains large glass windows which are exposed to either a significantly hotter or colder external environment. These windows tend to be highly conductive and due to the temperature gradient, may cause rapid alteration of the temperature and character of diffused air flow, thus preventing the room from attaining a uniform, comfortable temperature.

Various types of air distribution systems are known in the art. Typical of these systems is the "Air Distributor" detailed in U.S. Pat. No. 3,276,348, dated Oct. 4, 1966, to W. W. Kennedy. The air distributor apparatus detailed in this patent includes a device which is capable of discharging air into a room through a narrow outlet slot to diffusers, wherein the air stream flowing through the diffusers toward the outlet slot is deflected toward one side wall of the diffusers to impinge against a laterally-projecting flange defining one side of the outlet slot. The air stream is directed laterally by the flange to enter the room along the ceiling and the direction of the air stream may be varied to change the discharge pattern by adjusting the position of the deflector in the diffusers. U.S. Pat. No. 3,302,550, dated Feb. 7, 1967, to Q. R. Thomson, details another "Air Distributor". This air distributor includes laterally-spaced, parallel walls which define the sides of an elongated passage that is adapted to receive a flow of air. Each of the parallel walls are fitted with an inwardly-directed wall, the inner edges of which are spaced to form a slot for the passage of air. An intermediate wall is held in spaced relationship to the parallel walls and terminates above the inwardly-directed walls to form a support for a pair of individually vertically-slidable vane members. Supports for the vane members are also provided in vertically adjusted positions to bear against the inwardly-directed walls when in a fully lowered position, to prevent the flow of air through the slot. An "Air Diffusion Outlet With Laterally Adjustable Weir Control" is detailed in U.S. Pat. No. 3,411,425, dated Nov. 19, 1968, to R. R. Lambert. The diffuser is designed for use in suspended ceiling installations and includes a pair of parallel, spaced ceiling elements, each including an upstanding leg and bottom flanges, with the bottom flanges extending toward each other to define the diffuser outlet. Attachment means is also provided for interconnecting the pair of ceiling elements in a predetermined, spaced relationship, with the flanges spaced from each other and located in the ceiling plane to form the diffuser outlet in the plane of the ceiling. A weir member is located between the legs of the ceiling elements and means for mounting the weir members in a plane parallel to the ceiling plane, but spaced above the flanges, is provided for lateral movement in the plane to vary the direction of air flow through the outlet. U.S. Pat. No. 3,601,033, dated Aug. 24, 1971, to Robert R. Lambert, details an "Air Diffuser Assembly with Integral Air Return". The assembly detailed in this patent includes a blanked-off channel mounted in a suspended ceiling-integrated air distribution system, for blanking off a portion of the assembly from a continuous outlet of an air plenum chamber. A series of openings is also provided through the members for venting air from a room into an attic space above the ceiling and outside the plenum chamber. The openings are initially closed by removable knock-out plates and the openings may be selectively closed after once being opened, by plates removably mounted to the members, to selectively change the flow of air in the room. U.S. Pat. No. 3,760,709, dated Sept. 25, 1973, to J. R. Rachlin, et al, details a "Ventilating Air Distributing Channel Spreader-Supporting Bracket". The apparatus includes a lower air flow channel section formed of two extruded metal bars having vertical webs, with hooks on the outside of the webs for defining ways, into which ways the wings of a bracket project, to hold the bars in a channel assembly. A clip integral with the bracket hooks over the top of a grid tee and has gripper confirmations to mate with a clip on the opposite side of the tee to align the channels. The air from the duct discharges through the opening between the webs and a spreader directs the air generally outwardly, as well as downwardly. In one aspect of the invention special brackets are provided to support the air flow spreader in a proper position. U.S. Pat. No. 3,919,928, dated Nov. 18, 1975, to Robert R. Lambert, details a "Suspended Ceiling and Air Distribution Arrangement". The apparatus includes a linear air plenum formed of duct board and carries a linear diffuser. The air plenum diffuser assembly is used with a ceiling having a series of main and cross-runner T-bars or similar ceiling support members. With the diffuser carried by the linear plenum, a slot is provided in the ceiling by an air track. Alternatively, the slot may be defined by an air bar which includes the diffuser elements, in which case the air plenum is provided with an air outlet collar which registers with the air bar. A number of these assemblies are connected end-to-end and arranged parallel to one of the cross or main runners and at right angles to the others. The lengths of the air plenum and the attached diffuser or air outlet collar are related to the module upon which the ceiling is designed and the diffuser or outlet collar length is less than the overall length of the air plenum.

Other patents which detail a "Jet Pair Weir Gate", U.S. Pat. No. 4,316,407, and an "Air Diffuser Assembly", U.S. Pat. No. 3,444,801, are also issued to R. R. Lambert.

It is an object of this invention to provide a new, improved and inexpensive air diffuser or bar which does not require a specially-designed plenum in the enclosure that receives the air diffuser or bar.

Another object of the invention is to provide a self-supporting, linear and modular air bar system which is simple to install, easy to operate and may be integrated into conventional ceiling support systems.

Yet another object of the invention is to provide a linear and modular air bar diffuser which is characterized by at least one set of pivoting air controllers mounted between a pair of spaced, curved deflectors that may be quickly and easily snapped onto, suspended in, or otherwise mounted in an existing plenum air handling system at a desired location without the necessity of extensive custom design work in the ceiling support system.

Still another object of this invention is to provide a linear and modular air bar having an improved, aesthetically pleasing, aerodynamic design which provides a high air volume at low pressure drop and low sound and power levels, using an improved air slot design and a combination sliding controller module or modules and pivoting controller section or sections, that facilitate a desirable "surface effect" in the air flow.

Another object of the invention is to provide a linear and modular air bar for suspended ceilings, which air bar is fitted with a pair of laterally slidable horizontal pattern controllers and spaced pivoting pattern controllers that facilitate comfortable air distribution in a room at reduced air volume in selected patterns with minimum air "dumping".

Yet another object of the invention is to provide a manually-adjustable air bar diffuser which combines a pair of sliding controller modules with a pivoting controller module or section and serves as an "air trough" which may be totally integrated with a suspended ceiling system, since the device becomes a fixed component of the structure and does not require relocation with tenant improvement.

A further object of this invention is to provide a modular air bar diffuser having a combination sliding controller module and pivoting controller module, which diffuser is suitable for use as a transition between different types of structural ceilings and for side wall applications, as well as flat-mount applications in a suspended ceiling system.

Still another object of this invention is to provide a linear and modular air diffuser or air bar which is characterized by a pivoting air controlling section or module that is sandwiched between a pair of spaced sliding controller sections or modules, each of the latter having a pair of vertically-spaced deflectors provided with facing, curved air channels that are spaced by an air slot, with a pair of spacers provided in each end of the deflectors and a pair of horizontal pattern controllers laterally and slidably mounted between the spacers in a middle segment of the deflectors, along with two sets of pivoting pattern controllers mounted in separate end segments of the deflectors in the pivoting air controlling section, for deflecting air flowing through the air bar across the curved air channels and through the air slot in a direction or directions determined by the positions of the horizontal and pivoting pattern controllers.

A still further object of the invention is to provide a segmented modular air bar which utilizes a selected number of horizontal sliding pattern controllers and pivoting pattern controllers and is capable of being mounted in conventional ceiling support systems and directing air from a plenum into a room in selected directions and volume.

SUMMARY OF THE INVENTION

These and other objects of the invention are provided in a new and improved linear and modular air bar designed for mounting in conventional ceiling support systems, which air bar includes a pair of sliding air controller modules, each of which includes a segment of a pair of elongated, spaced, curved deflectors that receive two sets of bottom and top end spacers containing laterally slidably-mounted, horizontal pattern controllers. Further included is a pivoting air controlling section disposed between the open segment of the curved deflectors and between the two sliding air controller modules and having a set of spaced pivoting pattern controllers mounted in spacer blocks provided in the spacers, for directing the air through air passages selectively defined by the deflectors and the pivoting pattern controllers, as well as between the pivoting pattern controllers, respectively, into a structure in a selected direction and volume. The curved deflectors and the respective horizontal pattern controllers and pivoting pattern controllers which characterize in the pattern controller design of this invention facilitate more efficient handling of a greater volume of air per linear foot in different air flow patterns than is possible using prior art air diffusers.

BRIEF DESCRIPTION OF THE DRAWINGS

The invention will be better understood by reference to the accompanying drawings, wherein.

DESCRIPTION OF THE PREFERRED EMBODIMENTS

Figure 1:
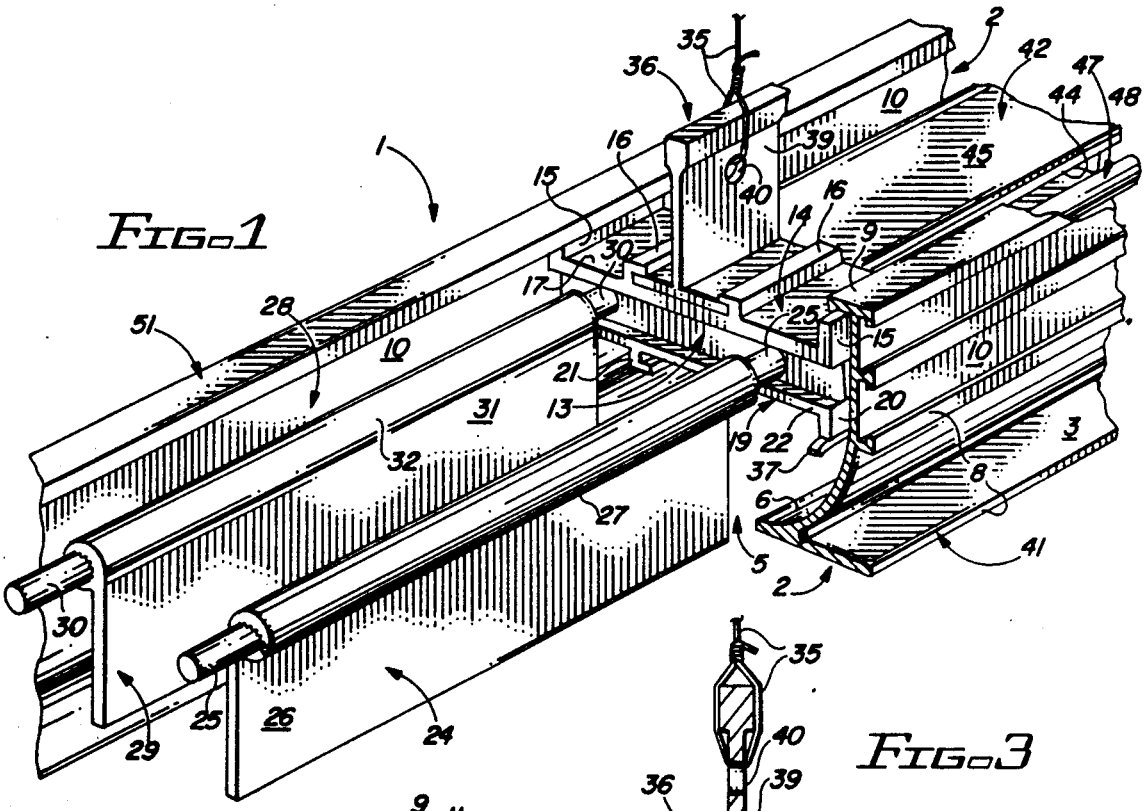
FIG. 1 is a perspective view, partially in section, of center and rear segments of a preferred embodiment of the pivoting controller and sliding controller modules of this invention.
Figure 2:
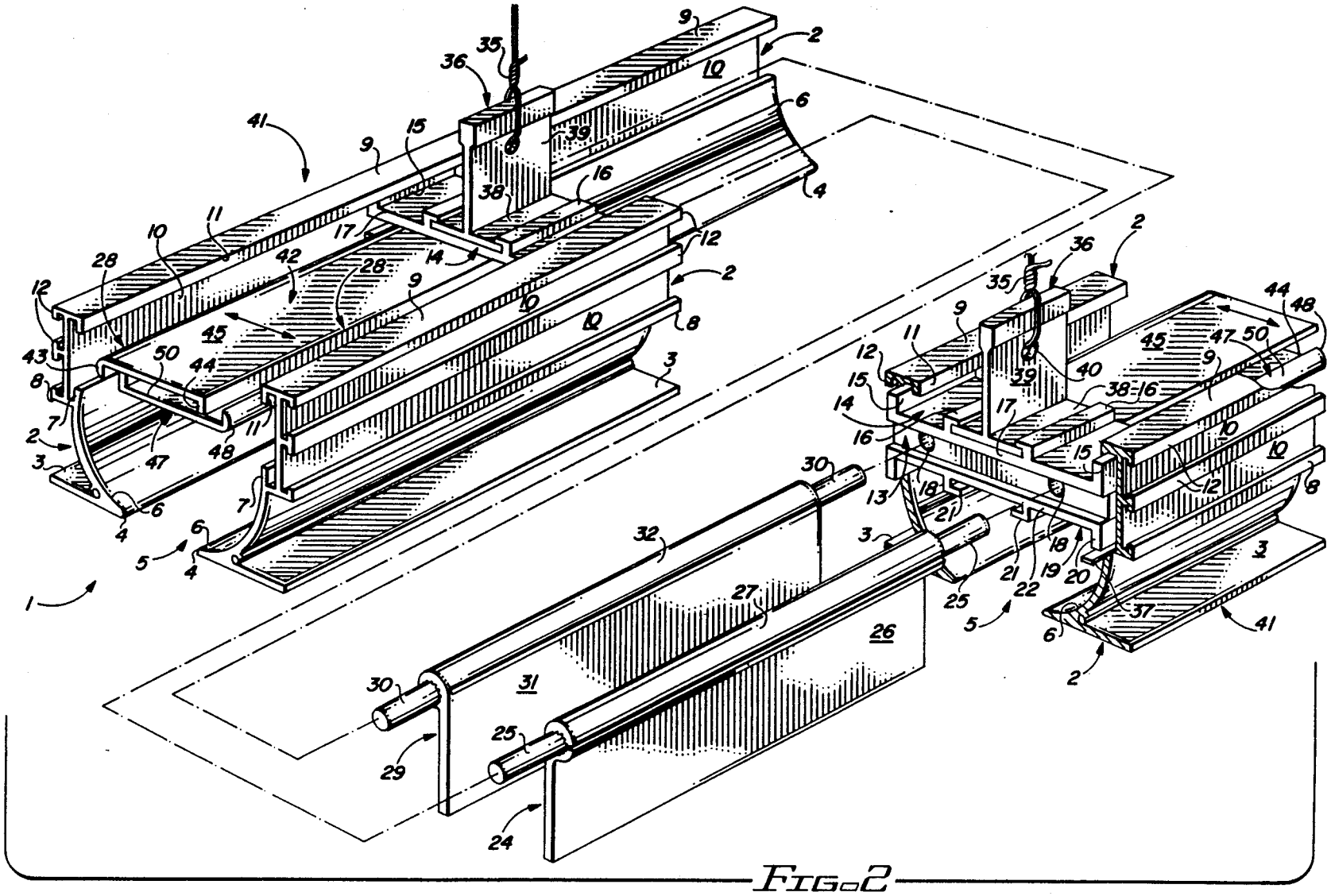
FIG. 2 is an exploded view of a preferred embodiment of the front, rear and center modules of the modular air bar illustrated in FIG. 1.

Referring to FIGS. 1 and 2 of the drawings, the modular air bar of this invention is generally illustrated by reference numeral 1 and includes a pair of sliding controller modules 41, spaced by a pivoting controller section 51. Each of the sliding controller modules 41 includes a pair of vertically-spaced deflectors 2, each fitted with a horizontally oriented, outwardly-extending deflector base 3, which is coplanar with the plane of a ceiling (not illustrated) when the modular air bar 1 is installed in functional configuration. Each deflector base 3 terminates inwardly in a base edge 4, which is spaced from the opposite base edge 4 to define an air slot 5. Each of the deflectors 2 is further provided with a curved air channel 6 which extends upwardly from the base edge 4, respectively, and terminates in an upward-standing air channel shoulder 7, as illustrated in FIG. 2. A bottom spacer seat 8 is shaped in each of the deflectors 2 and extends outwardly of each air channel shoulder 7 and a top spacer seat 9 is located above and opposite the bottom spacer seat 8 and is separated therefrom and connected thereto by a spacer seat connector 10, respectively. Each spacer seat connector 10 further includes spaced, outwardly-extending connector flanges 12, as illustrated, in order to receive one or more clips (not illustrated) for engaging the connector flanges 12 and joining multiple units of the modular air bar 1 together in parallel relationship, as necessary. A top spacer retainer 11 projects downwardly from the top spacer seat 9 opposite the top one of the connector flanges 12, respectively, and each bottom spacer seat 8 and top spacer seat 9 are designed to accommodate one of the parallel top spacer legs 15 and bottom spacer legs 20, respectively, of the top spacer 14 and the bottom spacer 19, respectively. The top spacer 14 is further characterized by a pair of spaced support flanges 16, which are upward-standing from a top spacer channel 17, and receive several spaced hanger brackets 36, suspended from the structure plenum (not illustrated) by means of a hanger wire 35, one of which hanger brackets 36 and hanger wire 35 combination is illustrated in FIGS. 1 and 2. The bottom spacer 19 further includes a pair of downwardly-extending bottom spacer flanges 21, connected to a bottom spacer channel 22 therein and the top spacer 14 and bottom spacer 19 are therefore interchangeable in the modular air bar 1. As illustrated in FIG. 2, a top pattern controller 42 is slidably seated in the space between the top spacer 14 and the bottom spacer 19 behind the spacer block 13 and is further characterized by a rounded, downwardly-extending top pattern controller head 43 and a downwardly-extending top pattern controller foot 44, which are spaced by and connected to a top pattern controller leg 45. A companion bottom pattern controller 47 is also fitted in the space between the top spacer 14 and the bottom spacer 19 in slidable contact with the bottom spacer 19 and the top pattern controller 24. Like the top pattern controller 42, the bottom pattern controller 47 is further characterized by a bottom controller leg 50, a bottom pattern controller foot 49 upwardly-extending from one end of the bottom controller leg 50 and a rounded, upwardly-extending bottom pattern controller head 48 connected to the opposite end of the bottom pattern controller leg 50. As illustrated in FIG. 2, the top pattern controller leg 45 slidably engages the top spacer 14 and the upward-standing bottom pattern controller foot 49. Furthermore, the downwardly-extending top pattern controller foot 44 slidably engages the corresponding bottom pattern controller leg 50, while the bottom pattern controller leg 50 slidably engages the bottom spacer 19. It will be appreciated from a consideration of FIGS. 1 and 2 that the top pattern controller 42 and the bottom pattern controller 47 are laterally slidably disposed in the space between the top spacer 14 and the bottom spacer 19 along the length of the deflector 2, such that the top pattern controller head 43 can be manually slidably extended to the left, as the modular air bar 1 is viewed in FIGS. 1 and 2, to engage the left-hand spacer seat connector 10 and the bottom pattern controller head 48 can be manually slidably extended to the right, to engage the right-hand spacer seat connector 10. This positioning of the top pattern controller 42 and the bottom pattern controller 47 substantially blocks the flow of air through those air passages 28 which are located in the sliding controller module 41 of the modular air bar 1, as hereinafter further described. It will be appreciated that the entire length of the top pattern controller 42 and the bottom pattern controller 47 are not illustrated in FIGS. 1 and 2, for purposes of clarity.

Figure 5:
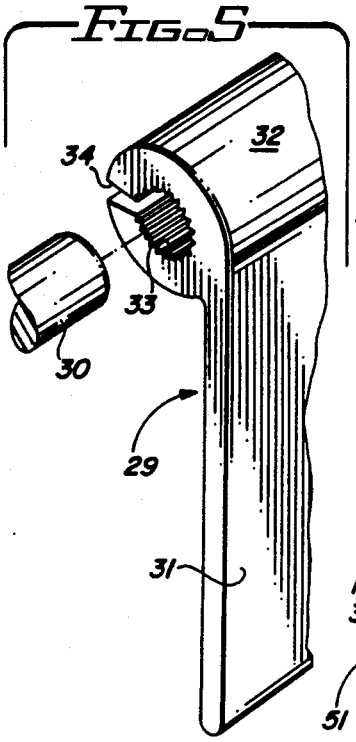
FIG. 5 is an enlarged sectional view of one end of a preferred pivoting pattern controller.

Referring now to FIGS. 1–5 of the drawings, like the sliding controller module 41, the pivoting controller section 51 of the modular air bar 1 is also defined by the parallel deflectors 2 and includes a right-hand pattern controller 24, having a right-hand pattern controller pin 25 that seats in pin apertures 18, provided in the oppositely-disposed spacer blocks 13, located in each of the sliding controller modules 41, respectively. The spacer blocks 13 are disposed between each set of top spacers 14 and bottom spacers 19, respectively, and a right-hand pattern controller blade 26 is fixedly mounted on the right-hand patter controller pin 25, as hereinafter further described. A left-hand pattern controller 29 is disposed in spaced, parallel relationship with respect to the right-hand pattern controller 24 and includes a left-hand pattern controller pin 30, pivotally mounted in corresponding, aligned pin apertures 18, also located in the respective spacer blocks 13 of the spaced sliding controller modules 41. A left-hand pattern controller blade 31 is mounted on the left-hand pattern controller pin 30 by means of pin mount splines 33 and a cooperating pin mount slot 34, located in the round left-hand pattern controller pin mount 32, which terminates the top edge of the left-hand pattern controller blade 31, as illustrated in FIG. 5. The right-hand pattern controller blade 26 is similarly mounted on the right-hand pattern controller pin 25.

Figure 3:
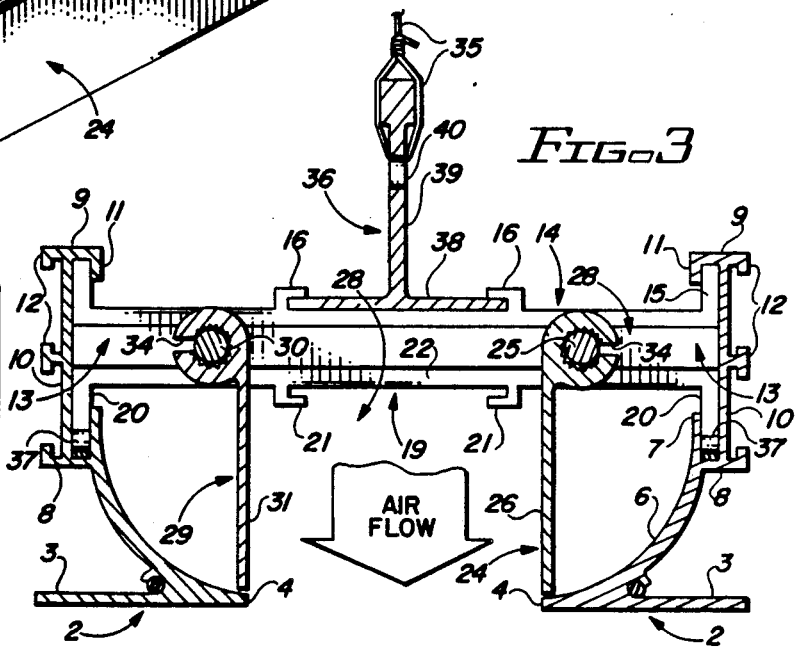
FIG. 3 is a sectional view of the pivoting controller section of the modular air bar illustrated in FIGS. 1 and 2, with the pivoting pattern controllers oriented in vertical configuration.
Figure 4:
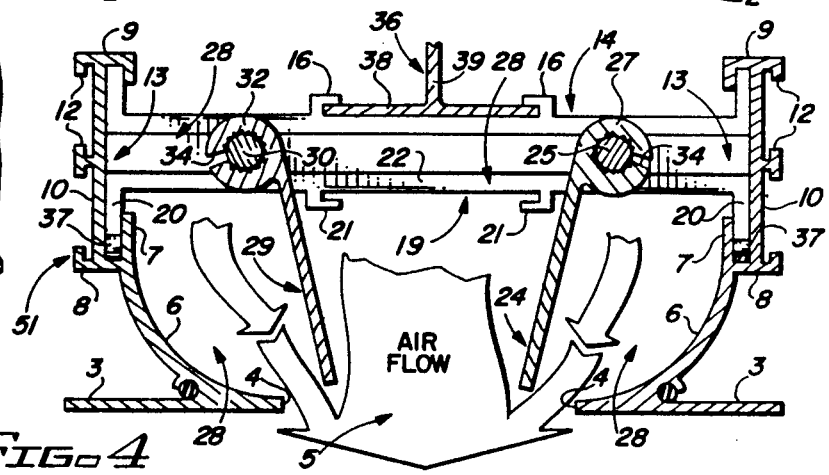
FIG. 4 is a sectional view of the pivoting controller module illustrated in FIG. 3, with the pivoting pattern controllers oriented in inwardly pivoted configuration.

Referring to FIGS. 2, 3 and 4 of the drawings, in a preferred embodiment of the invention a pair of spring clips 37 are fitted in the spaces between the air channel shoulders 7 and the spacer seat connectors 10, respectively, in order to receive the respective bottom spacer legs 20 and bias the top spacer 14 and the bottom spacer 19 into position against the top pattern controller 42 and the bottom pattern controller 47, respectively. This spring-loading of the top pattern controller 42 and the bottom pattern controller 47 serves to prevent inadvertent lateral slippage of the top pattern controller 42 with respect to the bottom pattern controller 47 and corresponding misadjustment of air flow through the air passage 28.

Referring again to FIGS. 1–4 of the drawings, during operation of the modular air bar 1, air flows through the air passages 28 of the sliding controller modules 41 in the modular air bar 1. These air passages 28 are located between the spacer seat connectors 10 and the respective top pattern controller head 43 and bottom pattern controller head 48, respectively, in the sliding controller modules 41 and both between the right-hand pattern controller 24 and the left-hand pattern controller 29, and adjacent to the curved air channels 6, in the pivoting controller section 51, throughout the length of the modular air bar 1, as illustrated. Accordingly, it will be appreciated that the path of air flow is of maximum size in the sliding controller modules 41 in the area between the respective spacer seat connectors 10 and the corresponding top pattern controller head 43 and bottom pattern controller head 48, when the top pattern controller 42 is fully retracted inwardly with respect to the bottom pattern controller 47. Conversely, extension of the top pattern controller head 43 and the bottom pattern controller head 48 across the air passages 28 to the respective spacer seat connectors 10, causes the top pattern controller leg 45 and the bottom pattern controller leg 50 to substantially block the air passages 28, since the respective top pattern controller leg 45 and bottom pattern controller leg 50 extend through the air passages 28, respectively. Accordingly, the modular air bar 1 is further adjusted to control the flow of air through the respective air passages 28 in the sliding controller modules 41 and the pivoting controller section 51, as follows. Referring to FIG. 2 of the drawings, if air flow through both of the spaced air passages 28 in the sliding controller modules 41 is desired, the top pattern controller 42 and bottom pattern controller 47 are manually slidably adjusted laterally with respect to each other between the top spacer 14 and the bottom spacer 19, such that the top pattern controller head 43 and the bottom pattern controller head 47 are spaced from the respective spacer seat connectors 10 to a desired extent. This adjustment partially opens the air passages 28 and allows air to flow through the modular air bar 1, as described above. Air flowing through the air passages 28 is directed to the air slot 5 by the oppositely-disposed, curved air channels 6 and the air is directed downwardly from the modular air bar 1 when the two streams of air meet at the air slot 5. As further illustrated in FIG. 2, when the bottom pattern controller head 48 is moved to the adjacent spacer seat connector 10 by shifting the bottom pattern controller 47 to the right as the modular air bar 1 is viewed in FIGS. 1 and 2, the right-hand air passage 28 is closed. Under these circumstances, air continues to flow through the left-hand air passage 28 and is directed through the air slot 5 at an angle, due to the curvature of the air channel 6 in the left-hand deflector 2. This action effects directional control of the air flow through the sliding controller modules 41 of the modular air bar 1 into a room or structure. The direction of this air flow can be reversed by opening the bottom pattern controller 47 and closing the top pattern controller 42 or shifting the bottom pattern controller 47 and the top pattern controller 42 in concert to the left, as viewed in FIG. 2, to facilitate air flow through the right-hand air passage 28. Accordingly, the volume of air flowing through either or both of the air passages 28 in either or both of the sliding controller modules 41 is controlled by slidably adjusting the top pattern controller 42 and the bottom pattern controller 47 inwardly and outwardly, as desired. Moreover, adjustment of the air flow into a room through that portion of the air slot 5 which traverses the pivoting controller section 51 is achieved by pivotally manipulating the respective right-hand pattern controller 24 and left-hand pattern controller 29 with respect to the curved air channels 6. This action adjusts the air flow past the respective air channels 6 in the parallel deflectors 2 through the air passages 28 between the respective outside surfaces of the parallel right-hand pattern controller blade 26 and the left-hand pattern controller blade 31. Alternatively, the right-hand pattern controller blade 26 and left-hand pattern controller blade 31 can be adjusted as illustrated in FIG. 3, with the right-hand pattern controller blade 26 and the left-hand pattern controller blade 31 pivoted downwardly in close proximity to the base edge 4 of each deflector base 4, respectively, to block the air passages 28 which are defined by the respective air channels 6. Pivoting of the right-hand pattern controller blade 26 and the left-hand pattern controller blade 31 inwardly as illustrated in FIG. 4, allows air to flow through these air passages 28, as well as the center-located air passage 28.

The components of the modular air bar 1 are typically constructed of extruded aluminum and it will be appreciated that the modular air bar 1 can be constructed to any desired dimensions and specifications for installation in an extended or "dropped" ceiling-plenum air handling system of substantially any design. Accordingly, it is understood that the modular air bar 1 can be installed in any desired spatial orientation, including modular side-by-side, interconnecting arrangement, parallel orientation or in a linear, end-to-end arrangement, with alternating sliding controller modules 41 and pivoting controlling sections 51, in non-exclusive particular. The modular air bar 1 may be suspended from the plenum ceiling by hanger wires 35, using connecting hanger brackets 36, having a bracket flange 38, bracket web 39 and a web opening 40, as illustrated in FIGS. 1 and 2, in the same manner as conventional suspended ceilings (not illustrated).

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A modular air bar for mounting an air distribution system, comprising a pair of horizontally-disposed, spaced air deflectors having facing, arcuate air channels terminating in concave, spaced relationship at the bottom thereof to define an air discharge opening; a plurality of substantially horizontally-disposed spacers connecting said air deflectors in vertically-spaced pairs; a pair of sliding air controlling sections spaced in said air deflectors, said sliding air controlling sections each characterized by a pair of elongated sliding pattern controller means slidably disposed between said air deflectors and said vertically-spaced pairs of said spacers, respectively; and a pivoting air controlling section disposed between said sliding air controlling sections, said pivoting air controlling section characterized by a pair of pivoting pattern controller means pivotally carried by said spacers between said air deflectors; spacer blocks disposed between selected ones of said spacers, for receiving said pivoting pattern controller means in pivotal relationship, whereby air is directed between said air deflectors and at least one of said sliding pattern controller means in said sliding air controlling sections and over said pivoting pattern controller means in said pivoting air controller section, responsive to lateral slidable manipulation of said sliding pattern controller means and pivotal adjustment of said pivoting pattern controller means between said spacers, respectively.

2. The modular air bar of claim 1 further comprising retainer means carried by said air deflectors in vertically spaced relationship, said retainer means adapted to receive said spacers, respectively, in vertically spaced, substantially parallel relationship.

3. The modular air bar of claim 1 further comprising leg means provided in said spacers, respectively, said leg means adapted for engagement with said retainer means and wherein said sliding pattern controller means is disposed between said spacers, respectively.

4. The modular air bar of claim 1 wherein:

(a) said sliding pattern controller means further comprises a bottom sliding pattern controller having an elongated bottom plate extending substantially along the length of each of said sliding air controlling sections of said air bar; a bottom plate foot upward-standing from one edge of said bottom plate and a bottom plate head upward-standing from the opposite edge of said bottom plate; and a top sliding pattern controller comprising an elongated top plate extending substantially along the length of each of said sliding air controlling sections of said air bar in spaced, substantially parallel relationship with respect to said bottom plate, said top plate slidably engaging said bottom plate foot; a top plate foot extending downwardly from one edge of said top plate, said top plate foot slidably engaging said bottom plate and a top plate head extending downwardly from the opposite edge of said top plate, whereby said top plate is spaced from said bottom plate by said bottom plate foot and said top plate foot and air is directionally channelled between said air deflectors and said bottom plate head and said top plate head, respectively, in each of said sliding air controller sections, responsive to slidable lateral adjustment of said bottom sliding pattern controller and said top sliding pattern controller; and (b) said pivoting pattern controller means further comprises a pair of pattern controller blades independently pivotally disposed in spaced, parallel relationship in said spacer means.

5. The modular air bar of claim 4 further comprising a top retainer and a bottom retainer provided in each of said air deflectors and wherein said spacers further comprise a pair of top spacers and a pair of bottom spacers disposed in substantially parallel relationship with respect to said top spacers, respectively; said leg means are further characterized by a top set of legs projecting upwardly from said top spacers, respectively, for engaging said top retainer, respectively, and a bottom set of legs projecting downwardly from said bottom spacers, respectively, for engaging said bottom retainer, respectively; said bottom plate slidably engages said top spacers, respectively, and said top plate slidably engages said bottom spacers, respectively.

6. The modular air bar of claim 5 further comprising bias means inserted between said bottom set of legs and said bottom retainer, respectively, for biasing said bottom sliding pattern controller and said top sliding pattern controller between said bottom spacers and said top spacers, respectively.

7. A modular air bar for mounting in the air distribution system of a structure and directionally orienting an air flow into the structure, comprising:

(a) a pair of oppositely-disposed, elongated, continuous air deflectors disposed in spaced, horizontally parallel relationship, said air deflectors having facing, arcuate air channels terminating in concave spaced relationship at the bottom thereof to define an air discharge opening; a pair of sliding controller modules, each defined by spaced segments of said air deflectors in combination with a first pair of substantially horizontally-disposed, vertically-spaced spacers connecting said air deflectors and a second pair of substantially horizontally-disposed, vertically-spaced spacers connecting said air deflectors, said first pair of spacers spaced along said air deflectors from said second pair of spacers, respectively, to define said spaced segments of said air deflectors, respectively; and a pair of elongated sliding pattern controllers slidably and transversely disposed between said first pair of spacers and said second pair of spacers, respectively, said sliding pattern controllers each extending along said spaced segments of said air deflectors, respectively; and (b) a pivoting controller section disposed between said sliding controller modules, said pivoting controller section characterized by a spacer block mounted in each of said sliding controller modules between said first pair of spacers in one of said sliding controller modules and said second pair of spacers in the other of said sliding controller modules and a pair of parallel pivoting pattern controller blades pivotally carried by said spacer block, respectively, between said air deflectors, whereby the air flow is selectively directed between at least one of said air deflectors and at least one of said sliding pattern controllers in a first air flow pattern in said sliding controller modules and between said pattern controller blades and between at least one of said arcuate air channels and said pattern controller blades in a second air flow pattern in said pivoting controller section, and then through said air exit slot into the structure, responsive to slidable lateral manipulation of said first and second pair of sliding pattern controllers and pivotal adjustment of said pivoting pattern controller blades, respectively, with respect to said air deflectors.

8. The modular air bar of claim 7 further comprising retainer means carried by said air deflectors in vertically spaced relationship, said retainer means adapted to receive said spacers in vertically spaced relationship.

9. The modular air bar of claim 8 further comprising leg means provided in said spacers, respectively, said leg means adapted for engagement with said retainer means for maintaining said spacers in substantially horizontally-disposed relationship with respect to each other.

10. The modular air bar of claim 9 wherein said retainer means further comprises a top retainer and a bottom retainer provided in each of said air deflectors; said spacers further comprise a pair of top spacers and a pair of bottom spacers disposed in substantially parallel relationship with respect to said top spacers, respectively; said leg means are further characterized by a top set of legs projecting upwardly from said top spacers, respectively, for engaging said top retainer, respectively and a bottom set of legs projecting downwardly from said bottom spacers, respectively, for engaging said bottom retainer, respectively; said bottom plate slidably engages said top spacers, respectively, and said top plate slidably engages said bottom spacers, respectively.

11. The modular air bar of claim 10 wherein:

(a) said pair of sliding pattern controllers are further characterized by a bottom sliding pattern controller comprising an elongated bottom plate extending substantially along the length of each of said sliding controlling modules; a bottom plate foot upward-standing from one edge of said bottom plate and a bottom plate head upward-standing from the opposite edge of said bottom plate; and a top sliding pattern controller comprising an elongated top plate extending substantially along the length of each of said sliding controlling modules in spaced, substantially parallel relationship with respect to said bottom plate, said top plate slidably engaging said bottom plate foot; a top plate foot extending downwardly from one edge of said top plate, said top plate foot slidably engaging said bottom plate and a top plate head extending downwardly from the opposite edge of said top plate, whereby said top plate is spaced from said bottom plate by said bottom plate foot and said top plate foot and the flow of air is directionally channelled between said air deflectors and said bottom plate head and said top plate head, respectively, in each of said sliding controller modules, responsive to slidable lateral adjustment of said bottom sliding pattern controller and said top sliding pattern controller; and (b) said pivoting pattern controller blades are independently pivotally disposed in spaced, parallel relationship in said spacer block, respectively.

12. The modular air bar of claim 10 further comprising hanger attachment means attached to selected ones of said top spacers for suspending said modular air bar in the air distribution system, substantially parallel relationship.

* * * * *